US005597291A

United States Patent [19]

Bodzak et al.

[11] Patent Number: 5,597,291

[45] Date of Patent: Jan. 28, 1997

[54] FUEL FEED PUMP FOR A FUEL INJECTION PUMP FOR INTERNAL COMBUSTION ENGINES

[75] Inventors: Stanislaw Bodzak, Elsbethem; Hanspeter Mayer, Hallein, both of Austria

[73] Assignee: Robert Bosch GmbH, Stuttgart, Germany

[21] Appl. No.: 561,651

[22] Filed: Nov. 22, 1995

[30] Foreign Application Priority Data

Nov. 22, 1994 [DE] Germany ..... 44 41 505.2

[51] Int. Cl.[6] ..... F02M 41/12

[52] U.S. Cl. ..... 417/310

[58] Field of Search ..... 417/310; 418/102

[56] References Cited

U.S. PATENT DOCUMENTS

| | | | |
|---|---|---|---|
| 2,310,078 | 2/1943 | Herman | 417/310 |
| 3,146,720 | 9/1964 | Henry | 417/310 |
| 3,628,893 | 12/1971 | Carpigiani | 417/310 |
| 4,927,343 | 5/1990 | Longberry | 418/102 |
| 5,496,155 | 3/1996 | Noah et al. | 417/310 |

FOREIGN PATENT DOCUMENTS 0166995 3/1989 European Pat. Off. .

*Primary Examiner*—Richard E. Gluck
*Attorney, Agent, or Firm*—Edwin E. Greigg; Ronald E. Greigg

[57] ABSTRACT

Fuel feed pump for a fuel injection pump for internal combustion engines, with a pair of intermeshing gearwheels, the said pair being driven in rotation in a pumping chamber (3), which gearwheels feed fuel out of a suction space (13), connected to a supply tank, along a feed duct (17), formed between the end faces of the gearwheels and the circumferential wall of the pumping chamber (3), into a pressure space (15) connected to the fuel injection pump, and with a bypass duct (25) which connects the suction space (13) to the pressure space (15) and in which a pressure valve (31) controlling the maximum fuel pressure in the pressure space (15) is arranged. At the same time, according to the invention, the bypass duct (25) is integrated into the housing (1) of the fuel feed pump in such a way that the pressure valve (31) can be inserted into the housing (1) of the feed pump completely via the inlet orifice (19) of the suction space (13).

20 Claims, 2 Drawing Sheets

FUEL FEED PUMP FOR A FUEL INJECTION PUMP FOR INTERNAL COMBUSTION ENGINES

Prior Art

The invention relates to a feed pump for a fuel injection pump for internal combustion engines. A fuel feed pump of this type, known from EP 0,166,995 B1 and designed as a geared feed pump, feeds fuel out of a supply tank into the suction space of a fuel injection pump. For this purpose, the feed pump has a pair of gearwheels which mesh in external engagement and which feeds fuel out of a suction space, connected to the supply tank via a suction conduit, into a pressure space connected to the suction space of the fuel injection pump via a feed conduit. At the same time, to control the pressure in the pressure space or the feed quantity to the fuel injection pump, a bypass duct is provided between the pressure space and the suction space of the fuel feed pump. The opening of this bypass duct takes place in this case by means of a pressure valve which is inserted into the bypass duct and which, at a specific differential pressure between the pressure space and suction space, frees a specific opening cross section in dependence on the spring force of the pressure valve spring. The opening time of the pressure valve can be adjusted via the pretensioning force of the pressure valve spring, for which purpose the axial position of the abutment of the pressure valve spring can be adjusted.

However, in this case the disadvantage of the known fuel feed pump is that the bypass duct receiving the pressure valve is arranged outside the feed pump or at least spatially relatively far from the pair of gearwheels, thus resulting in an increased outlay in terms of construction and assembly and in a high constructional space.

ADVANTAGES OF THE INVENTION

In contrast to this, the advantage of the fuel feed pump according to the invention for a fuel injection pump for internal combustion engines is that the bypass duct receiving the pressure valve is integrated into the housing of the feed pump and thus does not take up any additional constructional space. At the same time, it is particularly advantageous to arrange the bypass duct in such a way that it can be introduced into the housing of the feed pump through one of the connecting orifices of the latter, so that an additional orifice in the pump housing can be dispensed with, thereby reducing particularly the outlay in terms of machining (sealing off) on the entire feed pump. This is possible as a result of the advantageous complete insertion of the pressure valve into the pump housing. The bypass duct receiving the pressure valve is introduced in this case in a constructively simple way into the housing web forming one wall of the pumping chamber, thus moreover resulting in the advantage of a very short conduit length of the bypass duct. The valve seat of the pressure valve is formed in a constructively simple way in this case by a reduction in cross section at the end of the bypass duct located on the pressure space side, both a flat valve seat formed by a bore step and a conical valve seat formed by a conical change in cross section being possible. A valve closing member of the pressure valve cooperates by means of its valve sealing face with the valve seat face fixed relative to the housing, the said valve sealing face being formed in this case by a corresponding shaping of the end face of the valve closing member facing the valve seat. The valve closing member of the pressure valve is held in bearing contact on the valve seat by a valve spring which is supported on a clamping sleeve inserted into the bypass duct. This clamping sleeve having a throughflow cross section is inserted in this case into the end of the bypass duct located on the suction space side, the pretensioning force of the valve spring and therefore the opening pressure of the pressure valve being adjustable via the axial depth of insertion of the clamping sleeve. The clamping sleeve, which is easily accessible from one of the connecting orifices, can in this case be pressed in or screwed in, so that its axial position can be set very accurately. The bypass duct is formed in an advantageous way by a bore, the cross section of which, when projected in the axial direction, is located completely within the clear cross section of one of the connecting orifices, preferably the inlet orifice into the suction space, and can thus be produced easily by means of a tool which can be introduced into the inlet orifice. Alternatively to this, however, it is also possible to provide the pressure orifice out of the pressure space in such a way that the bypass duct can be made through this pressure orifice, in which case an additional component reducing the cross section of the bypass duct is to be provided.

Further advantages and advantageous embodiments of the subject matter of the invention can be taken from the description, the drawing and the patent claims.

BRIEF DESCRIPTION OF THE DRAWINGS

An exemplary embodiment of the fuel feed pump according to the invention is represented in the drawing and is explained in more detail in the following description.

DESCRIPTION OF THE EXEMPLARY EMBODIMENT

Figure 1:
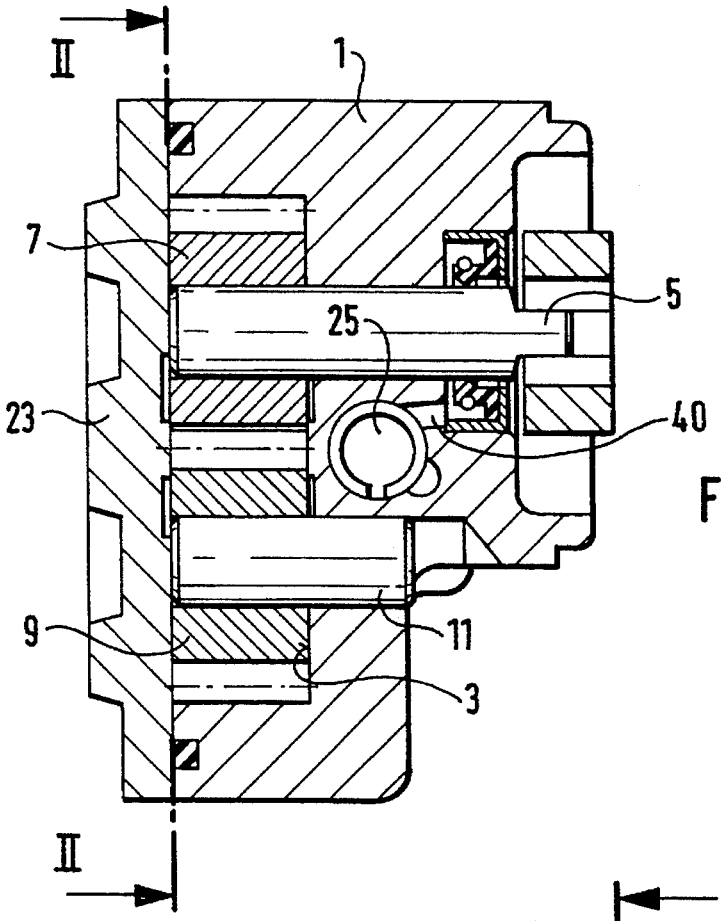
FIG. 1 shows a longitudinal section through the fuel feed pump along the line I—I of FIG. 2.
Figure 2:
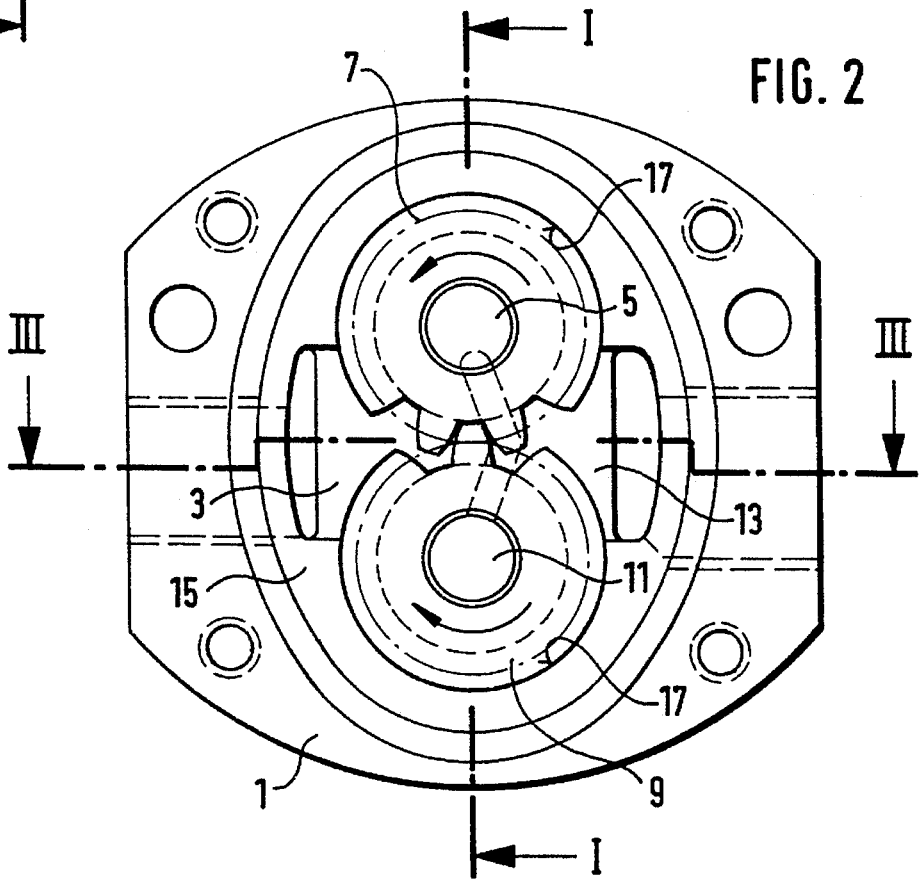
FIG. 2 shows a top view of the feed pump represented in FIG. 1, with the cover removed.
Figure 3:
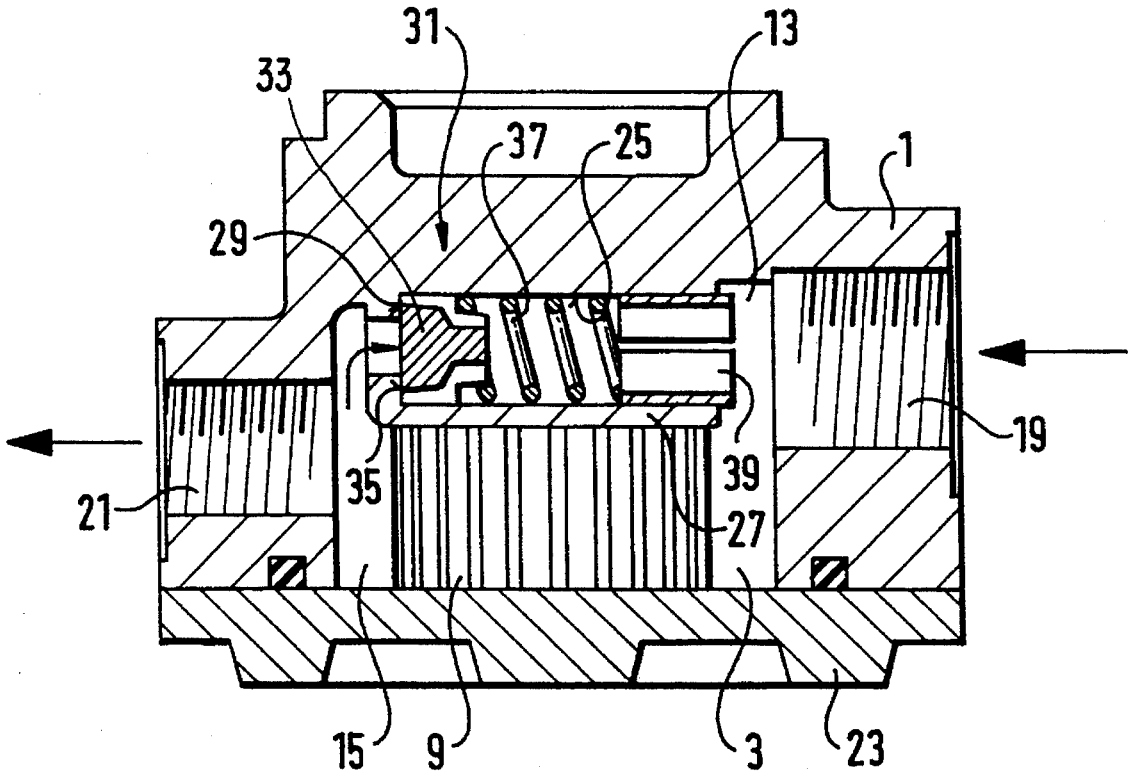
FIG. 3 shows a section through FIG. 2 along the line III—III, in which the position of the bypass duct and of the pressure valve arranged in it is represented.

The fuel feed pump represented in different views in FIGS. 1 to 3 is connected into an inflow conduit (not shown) from a supply tank to a fuel injection pump for internal combustion engines. Here, the feed pump has in its housing 1 a pumping chamber 3, in which a rotary-driven pair of intermeshing gearwheels is arranged with only some of the teeth shown. Thus, a first gearwheel 7 fastened on a first shaft 5 is driven in rotation by means of an external drive element (not shown in more detail) and transmits this rotational movement by means of a spur toothing to a second gearwheel 9 which meshes with the first gearwheel 7 and is arranged on the second housing-mounted shaft 11. The gearwheels 7, 9, by their tooth engagement, divide the pumping chamber 3 into two parts, of which a first part forms a suction space 13 and a second part a pressure space 15. The suction space 13 is connected in this arrangement to the pressure space 15 via a feed duct 17 formed in each case between the tooth grooves on the end faces of the first gearwheel 7 and of the second gearwheel 9 and the circumferential wall of the pumping chamber 3. Moreover, the suction space 13 and the pressure space 15 each have, in the wall of the pump housing 1, a connecting orifice, via which the suction space 13 is connected to a suction conduit (not shown in more detail) from the supply tank and the pressure space 15 is connected to a feed conduit (likewise not shown) to the suction space of the fuel injection pump. At the same time, the connecting orifice into the suction space 13 forms an inlet orifice 19, and the connecting orifice into the pressure space 15 forms an outlet orifice 21. The pumping chamber 3 is closed on one end face in the axial direction of the shafts 5 and 11 by a housing cover 23 which, in the representation of FIG. 2, has been removed and thus allows a view of the pump interior.

Furthermore, a bypass duct 25 is provided in the pump housing I for a pressure control of the feed pressure in the pressure space 15. This bypass duct 25 is formed by a bore in a housing web 27 which limits the pumping chamber 3 on its end face facing away from the housing cover 23 and separates the pressure side from the suction side and which at the same time forms a pumping chamber wall. The bore forming the bypass duct 25 is arranged in such a way in this case that its cross section, when projected in the axial direction, is located completely within the clear cross section of the inlet orifice 19. The bore 25 forming the bypass duct 25 is designed as a passage bore, of which one end opens into the pressure space 15 and the other end opens into the suction space 13. At the end located on the pressure space side, the bypass duct 25 has a reduction in cross section in the direction of the pressure space 15, the said reduction being formed by a bore step, the annular shoulder formed, located on the bypass duct side, forming a valve seat 29 of a pressure valve 31 inserted into the bypass duct 25. A valve closing member 33 of the pressure valve 31 comes to bear with a sealing face 35, formed on its end face located on the pressure space side, on this valve seat 29 as a result of the force of a valve spring 37. This valve spring 37 in the bypass duct 25 engages here via a step on the valve closing member 33 and, on the other hand, is supported on a clamping sleeve 39 inserted into the end of the bypass ducts 25 located on the suction space side. This clamping sleeve 39 can be inserted in this arrangement into the bypass duct 25 via the inlet orifice 19 in a similar way to the remaining components of the pressure valve 31, the pretensioning force of the valve spring 37 and therefore the opening pressure of the pressure valve 31 in the bypass duct 25 between the pressure space 15 and the suction space 13 being capable of being set via the axial depth of penetration of the clamping sleeve which frees a throughflow cross section. The clamping sleeve 39 can be pressed into the bypass duct 25 in this case or screwed in by means of a thread, so that a very accurate axial fixing of the clamping sleeve 39 in position is possible.

Furthermore, there is provided between a radial shaft seal of the first shaft 5 and the bypass duct 25 an overflow duct 40 (FIG. 1), via which the sealing ring of the first shaft 5 can be connected to the suction space of the pump, so that the pressure prevailing there can expand into the pumping chamber 3.

The fuel feed pump according to the invention works as follows. When the internal combustion engine is in operation, the fuel injection pump and fuel feed pump are driven in proportion to the rotational speed of the internal combustion engine. In the case of the feed pump represented in FIGS. 1 to 3, this takes place by means of a mechanical transmission element engaging from outside on the first shaft 5. As a result of the rotation of the first gearwheel 7 and of the second gearwheel 9 meshing with this, fuel is fed out of the suction space 13 along the feed duct 17 into the pressure space 15. At the same time, a negative pressure occurs in the suction space 13 and is sufficient to suck in fuel out of the supply tank via the suction conduit. The fuel pressure built up in the pressure space 15 causes a feed of fuel out of this via a feed conduit into the suction space of the fuel injection pump to be supplied. At the same time, the control of the maximum fuel pressure in the pressure space 15 and therefore of the feed quantity to the fuel injection pump takes place via the bypass conduit 25, in that the valve closing member 33 of the pressure valve 31 inserted therein lifts off from the valve seat 29 starting from a specific pressure in the pressure space 15 and thus opens a flow-off cross section at the bypass duct 25, via which flow-off cross section part of the fuel quantity which is under high pressure flows off out of the pressure space 15 into the suction space 13. At the same time, the opening pressure of the pressure valve 31 can be matched to the particular requirements via the pretensioning force of the valve spring 37 which can be set by means of the depth of insertion of the clamping sleeve 39.

It is thus possible, by means of the fuel feed pump according to the invention, to integrate the pressure valve limiting the maximum feed pressure into the housing of the feed pump in such a way that there is no need in the housing wall for any additional orifices which would have to be sealed off relative to the outside, thereby considerably reducing the outlay in terms of machining on the feed pump.

The foregoing relates to preferred exemplary embodiments of the invention, it being understood that other variants and embodiments thereof are possible within the spirit and scope of the invention, the latter being defined by the appended claims.

We claim:

1. A fuel feed pump for a fuel injection system of internal combustion engines, comprising a housing, a pair of intermeshing gearwheels in said housing, said pair of gearwheels being rotatable in a pumping chamber (3), said gearwheels feed fuel out of a suction space (13), connected to a supply tank, along a feed duct (17), formed between an end face of the gearwheels and a circumferential wall for the pumping chamber (3), into a pressure space (15) in said housing, and a bypass duct (25) is formed in the pump housing relative to the pumping chamber (3), said bypass duct (25) connects the suction space (13) to the pressure space (15) of the fuel feed pump, said bypass duct includes a valve seat face (29) with a pressure valve (31) arranged in said bypass duct relative thereto, said pressure valve (31) controls fuel pressure in the pressure space, the pressure valve (31) is inserted into and secured in the bypass duct (25) by a securing means via an inlet opening of the intake chamber.

2. The fuel feed pump as claimed in claim 1, wherein the bypass duct (25) is arranged in a housing web (27) which separates the pressure side of the feed pump from its suction side and which forms a pumping chamber wall adjacent to one of the axially facing side faces of the gearwheels.

3. The fuel feed pump as claimed in claim 2, wherein the bypass duct (25) is formed by a bore which is located in the housing web (27) in which one end opens into the suction space (13) formed by a first part of the pumping chamber (3) and a second end opens into the pressure space (15) formed by a second part of the pumping chamber (3), the suction space (13) and pressure space (15) being delimited from one another by a gearwheel engagement of the gearwheels and being connected by means of a respective connecting orifice to a suction conduit from the supply tank and to a feed conduit to a fuel injection pump, the connecting orifice into the suction space (13) forming an inlet orifice (19) and the connecting orifice into the pressure space (15) forming an outlet orifice (21).

4. The fuel feed pump as claimed in claim 3, wherein the cross section of the bypass duct (25), when projected in the axial direction, is located completely within the clear cross section of the inlet connecting orifice.

5. The fuel feed pump as claimed in claim 3, wherein the connecting orifice covering the bypass duct (25) is the inlet orifice (19).

6. The fuel feed pump as claimed in claim 3, wherein the bypass duct (25) has, at one end located on the pressure space side, a reduction in cross section which forms said valve seat face (29) and on which said pressure valve (31) is brought to bear with a sealing face (35) by means of a valve spring (37) which is supported on one end by a clamping sleeve (39) inserted into the end of the bypass duct (25) located on the suction space side.

7. The fuel feed pump as claimed in claim 6, wherein the clamping sleeve (39) is pressed into the bypass duct (25).

8. The fuel feed pump as claimed in claim 6, wherein the clamping sleeve (39) is screwed into the bypass duct (25) by means of a thread.

9. The fuel feed pump as claimed in claim 1, wherein an overflow duct (40) is provided between a radial shaft seal of a first shaft (5) carrying a first gearwheel (7) and the bypass duct (25).

10. A fuel feed pump for a fuel injection system of internal combustion engines, comprising a housing, a pair of intermeshing gearwheels in said housing, said pair of gearwheels being rotatable in a pumping chamber (3), said gearwheels feed fuel out of a suction space (13), connected to a supply tank, along a feed duct (17), formed between an end face of the gearwheels and a circumferential wall for the pumping chamber (3), into a pressure space (15) connected to a fuel injection pump, and a bypass duct (25) is formed in the pump housing relative to the pumping chamber (3), said bypass duct (25) connects the suction space (13) to the pressure space (15) of the fuel feed pump, said bypass duct includes a valve seat face (29) with a pressure valve (31) arranged in said bypass duct relative thereto, said pressure valve (31) controls fuel pressure in the pressure space, the pressure valve (31) is inserted into the bypass duct and secured therein by a securing means via an outlet opening of the pressure chamber.

11. The fuel feed pump as claimed in claim 10, wherein the bypass duct (25) is arranged in a housing web (27) which separates the pressure side of the feed pump from its suction side and which forms a pumping chamber wall adjacent to one of the axially facing side faces of the gearwheels.

12. The fuel feed pump as claimed in claim 11, wherein the bypass duct (25) is formed by a bore which is located the housing web (27) in which one end opens into the suction space (13) formed by a first part of the pumping chamber (3) and a second end opens into the pressure space (15) formed by a second part of the pumping chamber (3), the suction space (13) and pressure space (15) being delimited from one another by a gearwheel engagement of the gearwheels and being connected by means of a respective connecting orifice to a suction conduit from the supply tank and to a feed conduit to a fuel injection pump, the connecting orifice into the suction space (13) forming an inlet orifice (19) and the connecting orifice into the pressure space (15) forming an outlet orifice (21).

13. The fuel feed pump as claimed in claim 12, wherein the cross section of the bypass duct (25), when projected in the axial direction, is located completely within the clear cross section of the outlet connecting orifice.

14. The fuel feed pump as claimed in claim 12, wherein the connecting orifice cowering the bypass duct (25) is the outlet orifice (21).

15. The fuel feed pump as claimed in claim 12, wherein the bypass duct (25) has, at one end located on the pressure space side, a reduction in cross section which forms said valve seat face (29) and on which said pressure valve (31) is brought to bear with a sealing face (35) by means of a valve spring (37) which is supported on one end by a clamping sleeve (39) inserted into the end of the bypass duct (25) located on the suction space side.

16. The fuel feed pump as claimed in claim 13 wherein the connecting orifice covering the bypass duct (25) is the outlet orifice (21).

17. The fuel feed pump as claimed in claim 13 wherein the bypass duct (25) has, at one end located on the pressure space side, a reduction in cross section which forms said valve seat face (29) and on which said pressure valve (31) is brought to bear with a sealing face (35) by means of a valve spring (37) which is supported on a clamping sleeve (39) inserted into one end of the bypass duct (25) located on the suction space side.

18. The fuel feed pump as claimed in claim 13, wherein the clamping sleeve (39) is pressed into the bypass duct (25).

19. The fuel feed pump as claimed in claim 13, wherein the clamping sleeve (39) is screwed into the bypass duct (25) by means of a screw thread.

20. The fuel feed pump as claimed in claim 10, wherein an overflow duct (40) is provided between a radial shaft seal of a first shaft (5) carrying a first gearwheel (7) and the bypass duct (25).

* * * * *